US005207264A

United States Patent [19]

You

[11] Patent Number: 5,207,264

[45] Date of Patent: May 4, 1993

[54] VERTICAL DIE CASTING MACHINE

[75] Inventor: Ching-Tsorng You, Sanchung, Taiwan

[73] Assignee: Jih-Lee You, Taipei Hsien, Taiwan

[21] Appl. No.: 751,102

[22] Filed: Aug. 28, 1991

[51] Int. Cl.[5] ..... B22D 17/12; B22D 17/20

[52] U.S. Cl. ..... 164/312; 164/314; 164/319; 164/321

[58] Field of Search ..... 164/319, 321, 312, 314, 164/120

[56] References Cited

U.S. PATENT DOCUMENTS

| | | | |
|---|---|---|---|
| 2,863,187 | 12/1958 | VanDusen et al. | 164/312 X |
| 3,344,848 | 10/1967 | Hall et al. | 164/312 |
| 3,472,308 | 10/1969 | Lauth | 164/319 X |
| 4,208,879 | 6/1980 | Segawa | 164/314 X |

FOREIGN PATENT DOCUMENTS

| | | | |
|---|---|---|---|
| 2017951 | 4/1971 | Fed. Rep. of Germany | 164/319 |
| 2900407 | 12/1979 | Fed. Rep. of Germany | 164/312 |
| 57-50266 | 3/1982 | Japan | 164/120 |
| 64-53754 | 3/1989 | Japan | 164/457 |
| 1-205863 | 8/1989 | Japan | 164/120 |
| 548367 | 3/1977 | U.S.S.R. | 164/312 |

*Primary Examiner*—J. Reed Batten, Jr.

*Attorney, Agent, or Firm*—Morton J. Rosenberg; David I. Klein

[57] ABSTRACT

The machine includes an upper secondary pressure cylinder to give an added pressure onto a backing plate to which an upper die half is attached, and a lower secondary pressure cylinder connected to a main pressure cylinder, which moves a plunger rod to squeeze molten metal into the casting cavity, in a lower section to give an added pressure onto the lower die half through the plunger rod of the main pressure cylinder.

3 Claims, 6 Drawing Sheets

VERTICAL DIE CASTING MACHINE

BACKGROUND OF THE INVENTION

The casting of metals has been practiced for more than 6000 years, using first copper, then bronze, and then iron. Die castings are produced by forcing molten metal under pressure into permanent steel dies. Die casting involves metal flow at high velocities induced by the application or pressure. Because of this high-velocity filling, die casting can produce shapes that are more complex than shapes that can be produced by permanent mold casting. In die casting, after the die has been closed and locked, molten metal is delivered to a piston pump, which may be cold or may be heated to the temperature of the molten metal. The pump plunger is advanced to drive the metal quickly through the feeding system while the air in the die escapes through vents. Sufficient metal is introduced to overflow the die cavities, fill overflow wells and develop some flash. As the extraneous metal solidifies, pressure is applied to the remaining metal and is maintained through a specified dwell time to allow the casting to solidify. The die opens and the casting is then ejected. While the casting die is open, it is cleaned, cooled and lubricated as required. Then the die closed and locked, and the cycle is repeated. In a cold-chamber system, molten metal is generally delivered from the bottom to a shot chamber and then filled into the casting cavity by means of the operation of a pump plunger which is disposed in a horizontal position. Because molten metal is filled into the casting cavity from the bottom, the lower part of the molten metal filled in the casting cavity will become solidified firstly. Therefore, it is very difficult to arrange a suitable pouring hole. Since the lower part may be solidified while molten metal is still pouring through the pouring hole, it is difficult to obtain a satisfactory homogeneous solid of the die casting, and a high pressure cylinder or booster equipment is difficult to install.

SUMMARY OF THE INVENTION

The present invention has been accomplished to eliminate the aforesaid problems. It is therefore an object of the present invention to provide a vertical die casting machine which can eliminate bubbles from the molten metal. It is another object of the present invention to provide a vertical casting machine which permits molten metal to be poured into the casting cavity uniformly. It is still another object of the present invention to provide a vertical casting machine which has means to apply repeated pressure to increase the density of the castings made.

In the present invention, filling of molten metal into the shot chamber causes the plunger rod to move downwards smoothly, and therefore, less bubbles would be contained in the molten metal to be squeezed into the casting cavity for casting. A lower secondary pressure cylinder is incorporated to the main pressure cylinder at the bottom to give an added pressure onto the plunger rod of the main pressure cylinder after molten metal having been squeezed into the casting cavity. An upper secondary pressure cylinder is mounted on an upper platen at the top to give an added pressure onto the backing plate to which the upper die half is attached. Through the operation of the main, upper secondary and lower secondary pressure cylinders, die castings of higher density can be achieved.

DETAILED DESCRIPTION OF THE PREFERRED EMBODIMENT

Figure 1:
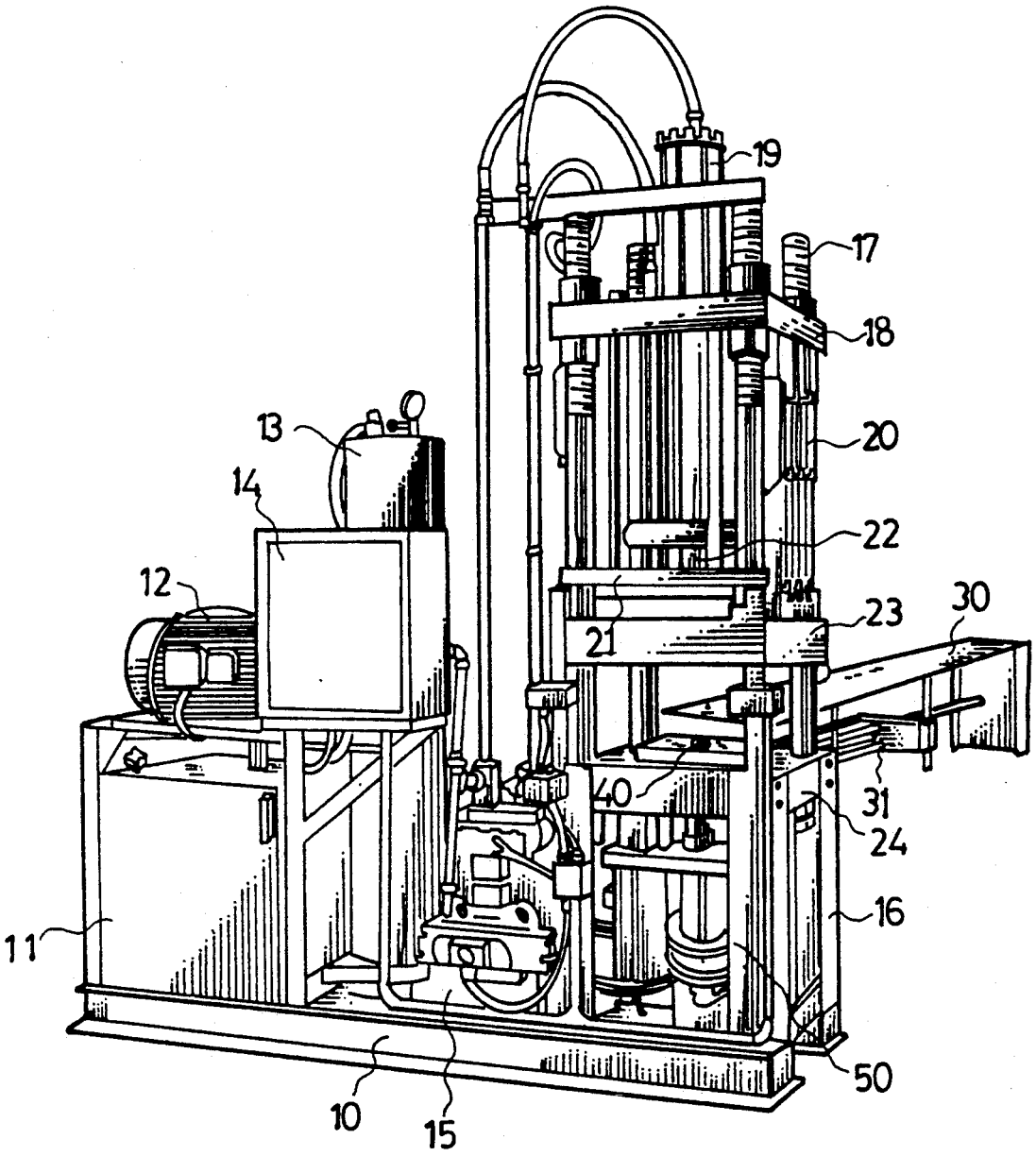
FIG. 1 is a front elevational view of the preferred embodiment of the vertical die casting machine of the present invention.

Referring to FIG. 1, therein illustrated is a vertical die casting machine embodying the present invention which generally comprises an oil tank 11 mounted on the machine base 10 thereof at the top at one side, a motor 12 mounted on said oil tank 11 at the top to drive an oil pump (not shown) to pump hydraulic oil from said oil tank 11 into a hydraulic oil circulation system, an accumulator 13 mounted on said machine base 10 at the top adjacent to said oil tank 11, which accumulator 13 has an oil meter and a helium feed hole, a control box 14 mounted on said machine base 10 in front of said accumulator 13, a control valve set 15 fastened on the bottom of said machine base 10 at the middle, and a supporting frame 16 mounted on said machine base 10 at the top at one side opposite to said oil tank 11.

The supporting frame 16 has tie bars 17 fastened in the four corners thereof to hold an upper platen 18, a lower platen 24 which has a shot chamber 40 through the center, and an intermediate platen 23. The upper platen 18 has a clamp-cylinder 19 and an upper secondary pressure cylinder 22 respectively mounted thereon at the top and a crank 20 fastened therein at the bottom which crank 20 is coupled with a backing plate 21 for holding an upper die half. Turning on the clamp-cylinder 19 causes the upper platen 18 to move up or down along the tie bars 17. The intermediate platen 23 has an opening at the center (not shown) through which the upper die half (not shown) can be moved toward the lower die half (not shown) which is mounted on the lower platen 24 at the top.

Below the lower platen 24, there is provided a main pressure cylinder 50 and a lower secondary pressure cylinder 60. There is also provided a table 30 disposed adjacent to the supporting frame 16 between the intermediate and lower platens 23, 24 for collecting any die castings thus made through the die casting machine. Further, the plunger of the main pressure cylinder 50 is controlled by a limit switch to move in the shot chamber 40 smoothly so that bubbles can be greatly reduced from the molten metal when the molten metal is delivered into the casting cavity.

Figure 2:
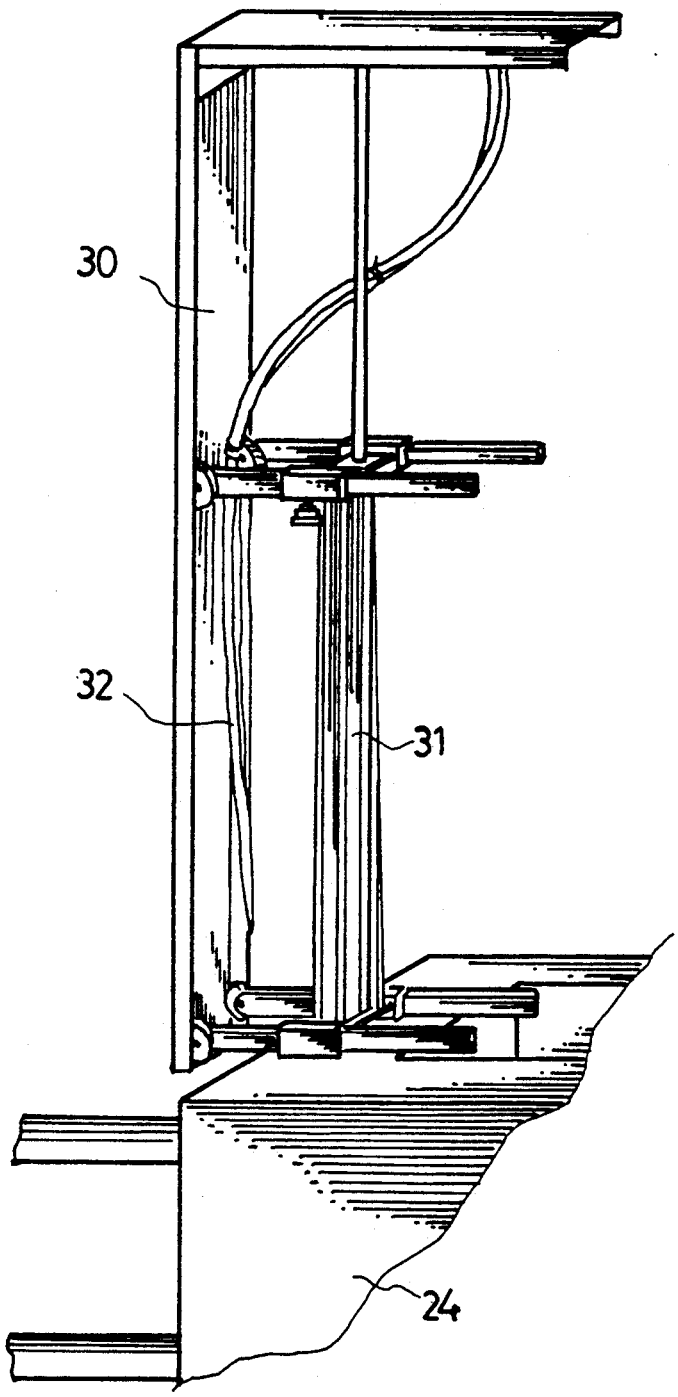
FIG. 2 is a schematic structural view of the table for collecting die castings.

Referring to FIG. 2, the table 30 is secured to the lower platen 24 and controlled by a hydraulic cylinder 31. A stripping agent conduit pipe 32 is fastened in the table 30 to spray stripping agent on the lower die half before each die casting process. Therefore, the die casting thus formed after each die casting process is secured to the upper die half and moved to the table 30 for stripping.

Figure 3:
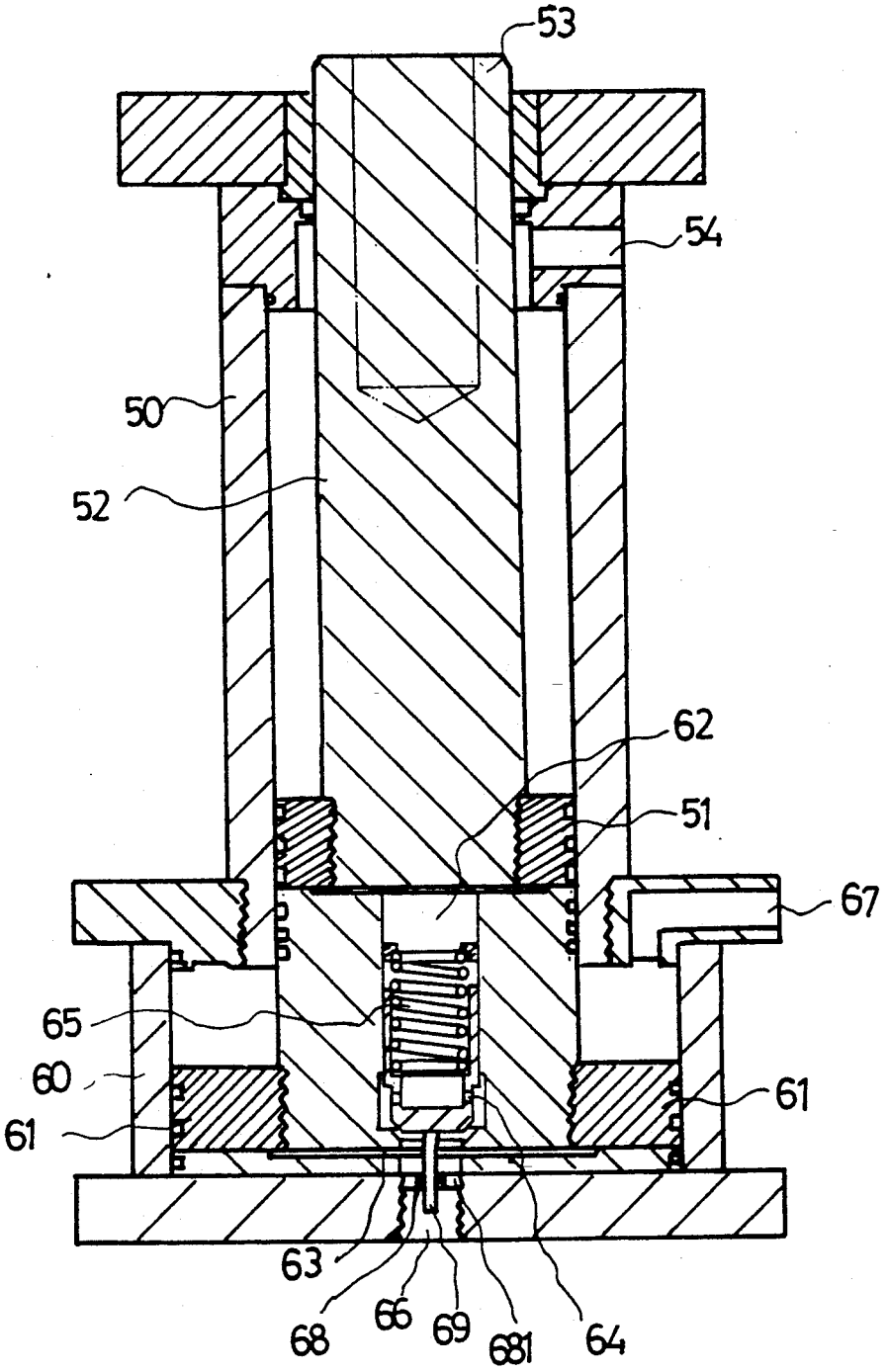
FIG. 3 is a sectional view of the main pressure cylinder and the lower secondary pressure cylinder taken along longitudinal direction.
Figure 7:
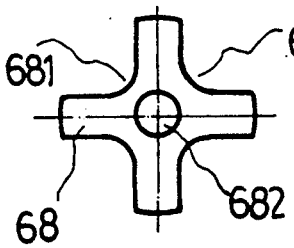
FIG. 7 is a cross section of the push rod holder.

Referring to FIG. 3, the lower secondary pressure cylinder 60 is fastened below the main pressure cylinder 50 to give added pressure to the main pressure cylinder 50. The main pressure cylinder 50 has a plunger 51 movably fastened therein to alternatively move a plunger rod 52 back and forth, and an oil relief port 54 through the outer wall thereof at a suitable location for the return circulation of hydraulic oil to the oil tank 11, wherein said plunger rod 52 has a fastening hole 53 at the center for mounting a plunger tip (not shown). The lower secondary pressure cylinder 60 has a piston 61 movably fastened therein, which piston 61 has a center hole 62 at the center with a check valve 63 fastened therein at the bottom, which check valve 63 has a side hole 64 for the passing therethrough of hydraulic oil. Inside the center hole 62 on the piston 61 there is fastened a spring 65 which constantly forces the check valve 63 downwards. The lower secondary pressure cylinder 60 further comprises an oil inlet hole 66 on the bottom at the center for the filling therein of hydraulic oil and a cross-shaped push rod holder 68 fastened in said oil inlet hole 66 through screw joint. As illustrated in FIG. 7, the cross-shaped push rod holder 68 has four notches 681 around the periphery thereof and a center hole 682 at the center for fastening a push rod 69. When the piston 61 is retained at the lower limit position inside the lower secondary pressure cylinder 60, the check valve 63 is pushed upwards for a certain height by the push rod 69 permitting hydraulic oil to pass through the side hole 64. The lower secondary pressure cylinder 60 further has an oil pipe 67 attached thereto at an upper location for guiding out hydraulic oil above the piston 61 (This will be explained further).

Figure 4:
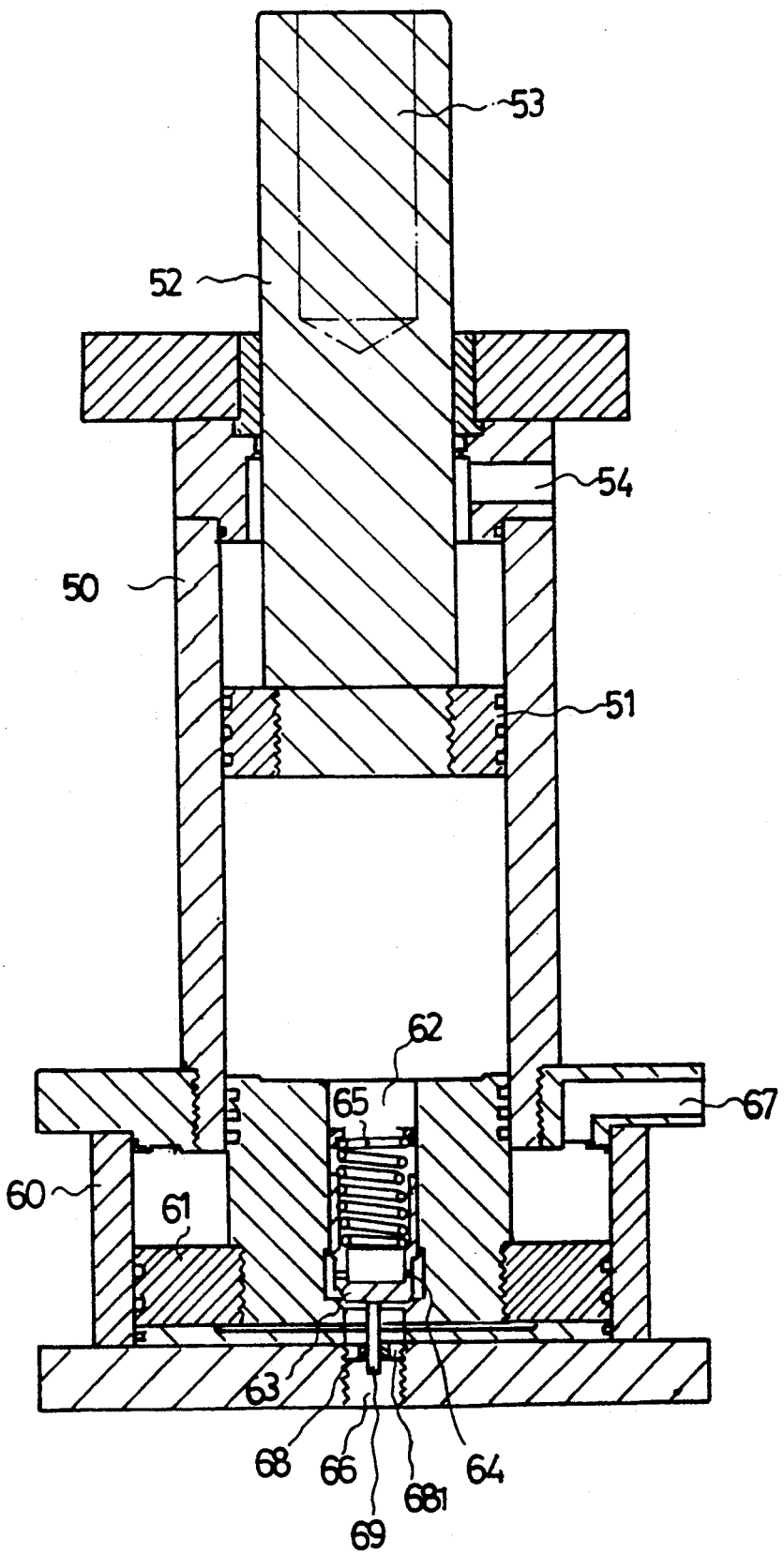
FIG. 4 is a sectional view of the main pressure cylinder and the lower secondary pressure cylinder showing that the plunger rod is moved upwards to squeeze molten metal into the casting cavity.
Figure 5:
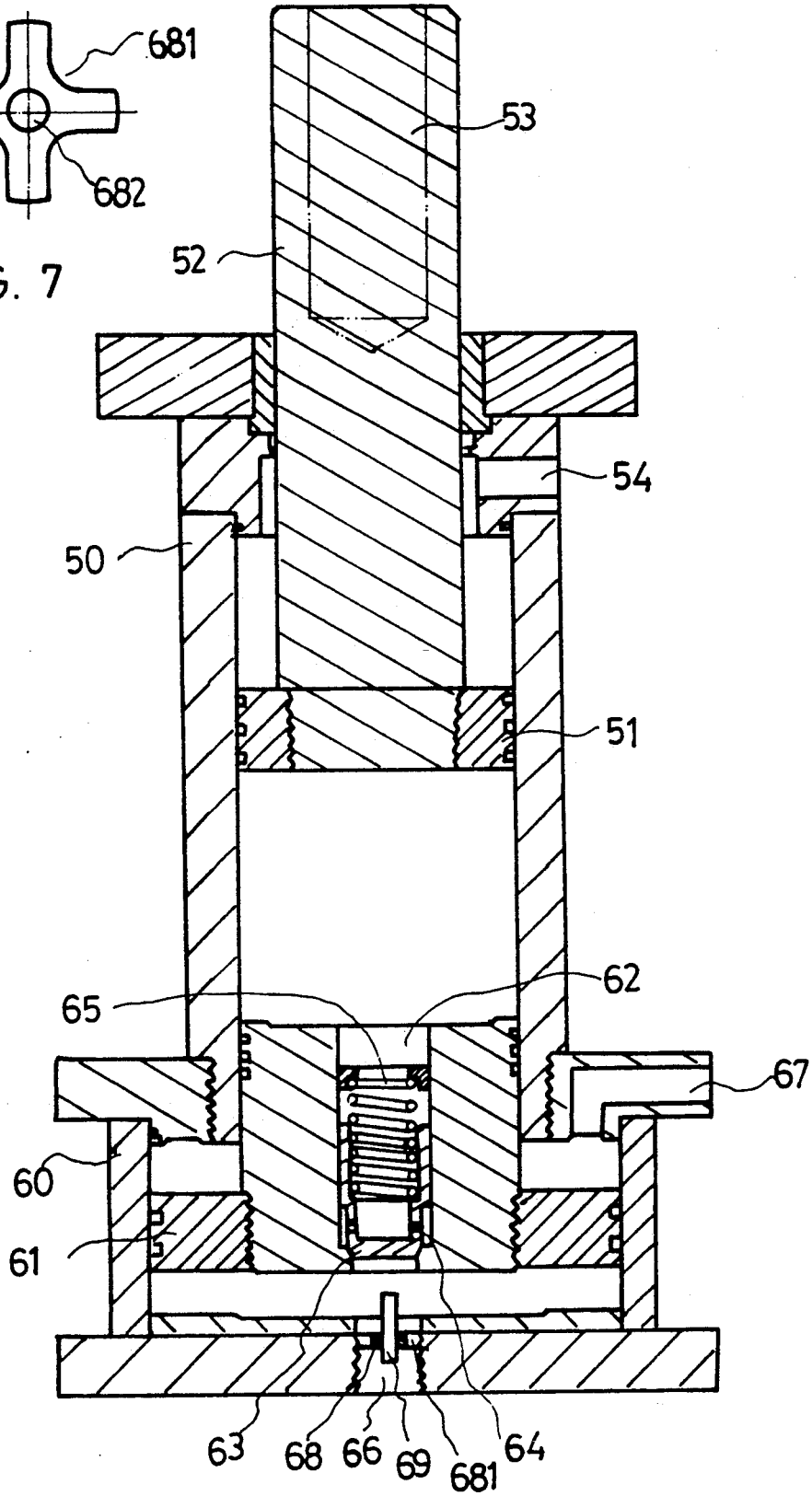
FIG. 5 is a sectional view of the main pressure cylinder and the lower secondary pressure cylinder showing that the piston of the lower secondary pressure cylinder is moved upwards to give an added pressure to the plunger of the main pressure cylinder against the die casting.

When molten metal is filled into the shot chamber 40, the clamp-cylinder 19 is turned on to close the upper and lower die halves. Then, the main pressure cylinder 50 is turned on to quickly squeeze molten metal from the shot chamber 40 into the casting cavity. Because the main pressure cylinder 50 has a cross section relatively smaller, the moving speed of the plunger 51 is relatively quicker so that the molten metal can be squeezed into the casting cavity more quickly. The operation of the main pressure cylinder 50 is as shown in FIG. 4. When the space above the piston 61 of the lower secondary pressure cylinder 60 is filled with hydraulic oil, the piston 61 is retained in position. At the same time, hydraulic oil which comes from the oil inlet hole 66 passes through the side hole 64 on the check valve 63 into the main pressure cylinder 50 to move the plunger 51 upwards, and therefore, molten metal is squeezed by the plunger tip of the plunger rod 52 into the casting cavity. After die filling and dwell, molten metal in the casting cavity starts to solidify into a die casting. During the process of solidification, the oil pipe 67 on the lower secondary pressure cylinder 60 is opened permitting hydraulic oil, which is maintained above the piston 61, to discharge out of the lower secondary pressure cylinder 60. Once hydraulic oil is completely discharged out of the lower secondary pressure cylinder 60, the piston 61 can be moved upwards (as shown in FIG. 5). Because the lower secondary pressure cylinder 60 has a cross section relatively bigger than the main pressure cylinder 50, it provides stronger push force to the plunger 51 causing it to squeeze the plunger tip of the plunger rod 52 thereof against the casting which is under process of solidification. Through the aforesaid arrangement and process, a die casting of higher density is achieved.

Figure 6:
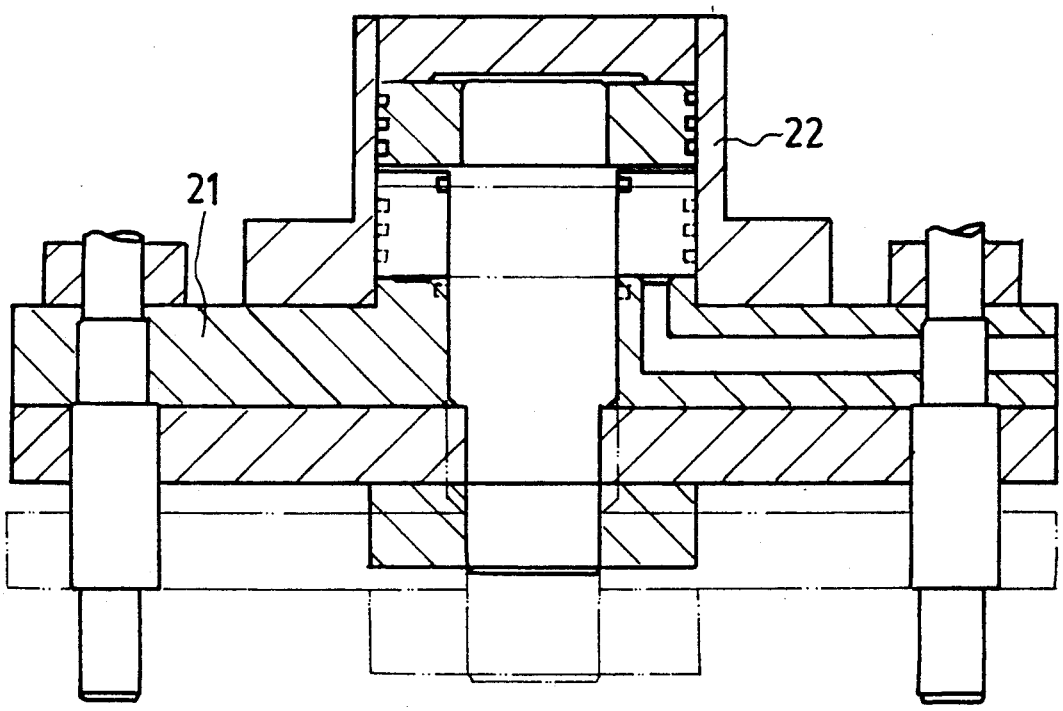
FIG. 6 is a sectional view of the upper secondary pressure cylinder to give an added pressure to the backing plate.

Referring to FIG. 6, the upper secondary pressure cylinder 22 is mounted on the backing plate 21 at the top. After the process of die filling and dwell and the squeezing operation of the lower secondary pressure cylinder 60, the upper secondary pressure cylinder 22 is turned on to give an added pressure to the backing plate 21 causing it to squeeze the upper die half further. Therefore, casting is repeatedly squeezed to increase its density and structural strength.

As indicated, the present invention is to provide a vertical die casting machine in which the die is held in a horizontal position so that molten metal can be inserted into the casting cavity in a uniform and smooth manner. Further, an upper secondary pressure cylinder 22 and a lower secondary pressure cylinder 60 are provided to give added pressure to the casting so as to increase its density and structural strength.

What is claimed is:

1. A vertical die casting machine having a machine base including an oil tank, an oil pump control motor, an accumulator, an electric control box, a control valve set and a supporting frame, said supporting frame having tie bars located in four corners thereof for securement of an upper platen, a lower platen, and an intermediate platen, said upper platen having a clamp-cylinder for displaceably driving said upper platen vertically along said tie bars and a crank mounted in a lower section to secure a backing plate for holding a die, characterized in that said lower platen includes a shot chamber formed therein for receiving molten metal, a main pressure cylinder located below said shot chamber for displacing a plunger tip into said shot chamber for filling said die, and a lower secondary pressure cylinder fluidly coupled to said main pressure cylinder to provide increased pressure to said plunger tip; said upper platen having an upper secondary pressure cylinder mounted thereon above said shot chamber to give an added pressure to said die from above.

2. The vertical die casting machine of claim 1, wherein said main pressure cylinder includes a plunger movably fastened thereto to reversibly move a plunger rod, said plunger rod having a centrally located fastening hole with said plunger tip fastened therein and an oil relief port formed through an outer wall thereof for return circulation of hydraulic oil to said oil tank; said lower secondary pressure cylinder having a piston movably fastened therein, a centrally located oil inlet hole formed on the bottom edge thereof for filling therein with hydraulic oil from said oil tank, and an oil pipe attached thereto at an upper section for guiding hydraulic oil to said oil tank, said piston having a center hole with a check valve fastened therein at a bottom section, said oil inlet hole having a cross-shaped push rod holder fastened therein, said push rod holder having side notches formed around the periphery thereof for the passing therethrough of hydraulic oil and a push rod at a top section to push said check valve upwards when said piston is moved to a lower limit position; wherein filling of said hydraulic oil through said oil inlet hole into said lower secondary pressure cylinder causes said check valve to be displaced from a position permitting hydraulic oil to pass through said piston for moving said plunger upwards whereby said plunger tip is moved to squeeze molten metal into the casting cavity defined by upper and lower die halves; said oil pipe being opened immediately after an up stroke of said plunger thereby permitting hydraulic oil to be discharged from a space above said piston so that said secondary piston can be moved upwards to provide increased pressure onto said lower die half by said plunger.

3. The vertical die casting machine of claim 2, wherein said check valve has a side hole at a lower location for the passing therethrough of hydraulic oil and said piston has a spring means fastened inside the center hole thereof to constantly force said check valve downwards.

* * * * *